US008004380B2

(12) United States Patent
Moiseev

(10) Patent No.: US 8,004,380 B2
(45) Date of Patent: Aug. 23, 2011

(54) TRANSFORMER

(75) Inventor: Sergey Moiseev, Aichi-ken (JP)

(73) Assignee: Kabushiki Kaisha Toyota Jidoshokki (JP)

( * ) Notice: Subject to any disclaimer, the term of this patent is extended or adjusted under 35 U.S.C. 154(b) by 0 days.

(21) Appl. No.: 12/270,037

(22) Filed: Nov. 13, 2008

(65) Prior Publication Data

US 2009/0128277 A1 May 21, 2009

(30) Foreign Application Priority Data

Nov. 15, 2007 (JP) ..... 2007-296502

(51) Int. Cl.
*H01F 27/28* (2006.01)
*H01F 21/02* (2006.01)
*H01F 17/06* (2006.01)
*H01F 17/04* (2006.01)

(52) U.S. Cl. ..... 336/170; 336/83; 336/146; 336/178; 336/182; 336/184; 336/221; 336/222; 336/223

(58) Field of Classification Search ..... None
See application file for complete search history.

(56) References Cited

U.S. PATENT DOCUMENTS

| | | | | |
|---|---|---|---|---|
| 4,538,132 | A * | 8/1985 | Hiyama et al. | 336/221 |
| 6,593,837 | B2 * | 7/2003 | Takayama | 336/83 |
| 6,707,366 | B2 * | 3/2004 | Hsu et al. | 336/200 |
| 7,268,657 | B2 * | 9/2007 | Yamasaki et al. | 336/180 |
| 7,280,026 | B2 * | 10/2007 | Chandrasekaran et al. | 336/212 |
| 7,612,640 | B2 * | 11/2009 | Sano | 336/83 |
| 2007/0035375 | A1 * | 2/2007 | Yang | 336/212 |
| 2007/0273465 | A1 * | 11/2007 | Feng et al. | 336/212 |

FOREIGN PATENT DOCUMENTS

| | | | |
|---|---|---|---|
| JP | 03-183361 | | 8/1991 |
| JP | 2000-353627 | A | 12/2000 |
| JP | 2002-057045 | * | 2/2002 |
| JP | 2002-057045 | A * | 2/2002 |
| JP | 2003-79142 | A | 3/2003 |
| JP | 2005-051994 | A | 2/2005 |
| JP | 2005-051995 | A | 2/2005 |
| JP | 2007-128984 | | 5/2007 |
| JP | 2007-296502 | A | 11/2007 |

* cited by examiner

*Primary Examiner* — Anh T Mai
*Assistant Examiner* — Mangtin Lian
(74) *Attorney, Agent, or Firm* — Woodcock Washburn LLP

(57) ABSTRACT

A transformer 10 has a first core CR1, a second core CR2, a first transformer primary winding W1, a coil 45, a coil 46 and a coil 47. The second core CR2 is integrally formed with the first core CR1. The first transformer primary winding W1 is wound onto the first core CR1. The coil 45 is wound onto the first core CR1 and forms a transformer T1 together with the first transformer primary winding W1. The coil 46 is wound around the first core CR1 and forms a transformer T2 together with the first transformer primary winding W1. The coil 47 is connected to the coil 45 and coil 46 and forms an output coil using the second core CR2 as a magnetic core.

7 Claims, 12 Drawing Sheets

TRANSFORMER

CROSS-REFERENCE TO RELATED APPLICATIONS

This application is based upon and claims the benefit of priority from the prior Japanese Patent Application No. 2007-296502 filed on Nov. 15, 2007, the entire contents of which are incorporated herein by reference.

BACKGROUND OF THE INVENTION

1. Field of the Invention

The invention relates to a transformer having an output coil integrally formed therewith.

2. Description of the Related Art

FIG. 12 shows a configuration of a transformer core including two integrated transformers, as disclosed in Japanese Unexamined Patent Publication No. 2005-51995. An I-shaped core 3000 is disposed on an E-shaped core 2000 and a first side wall 2003, and a gap G101 is formed between the I-shaped core 3000 and a center column 2002. Accordingly, a first gap closing magnetic circuit 6000 is formed to pass through the I-shaped core 3000, the first side wall 2003, a bottom plate 2001, the center column 2002, the gap G101 and the I-shaped core 3000. The gap closing magnetic circuit 6000 is a magnetic circuit for a transformer T101. An I-shaped core 4000 is disposed on the E-shaped core 2000 and a second side wall 2004, and a gap G102 is formed between the I-shaped core 4000 and the center column 2002. Accordingly, a second gap closing magnetic circuit 7000 is formed to pass through the I-shaped core 4000, the second side wall 2004, the bottom plate 2001, the center column 2002, the gap G102 and the I-shaped core 4000. The gap closing magnetic circuit 7000 is a magnetic circuit for a transformer T102.

Primary windings W101 and W104 are formed integrally, and wound around the center column 2002 by a specified number of turns. Similarly, primary windings W102 and W105 are formed integrally, and wound around the center column 2002 by a specified number of turns. Coils W103 and W106 constituting secondary windings are wound on the center column 2002 in a reverse direction by a half turn. Thus, a common transformer is formed by integrating transformers T101, T102.

As other related techniques, there are known the DC-DC converters as disclosed in Japanese Unexamined Patent Publication No. 2005-51994, Japanese Unexamined Patent Publication No. 2003-79142, Japanese Unexamined Patent Publication No. 2002-57045 and Japanese Unexamined Patent Publication 2000-353627.

SUMMARY OF THE INVENTION

However, in a conventional transformer as shown in FIG. 12, the output coil is not integrally formed. Accordingly, the output coil must be constructed of an independent coil element. This causes an increase in associated costs and in the number of components.

Simply integrating the output coil in the transformer may cause greater core loss and may complicate a wiring layout for the winding terminals of the transformer.

The invention is devised to solve at least one of the problems of the prior art as described above, and it is hence an object thereof to provide an output coil-integrated transformer capable of reducing core loss and preventing a wiring layout from becoming complicated.

In order to achieve the above object, there is provided a transformer comprising: a first core; a second core integrally formed with the first core; a first winding wound around the first core; a second winding wound around the first core and forming a first transformer together with the first winding; a third winding wound around the first core and forming a second transformer together with the first winding; and a fourth winding connected to the second winding and the third winding and forming an output coil with the second core as a magnetic core.

A first core and a second core are formed integrally. The first core has a first winding wound thereon. The first winding and the second winding compose a first transformer. Likewise, the first winding and a third winding compose a second transformer.

A second core is used for an output coil. The output coil is formed integrally with the transformer through a fourth winding, with the second core used as a magnetic core. The output coil no longer needs to be composed of an independent coil element, which makes it possible to reduce the number of elements.

The second core is used only by the fourth winding, making it possible to optimize the shape of the second core to match the fourth winding. The fourth winding can help reduce the length of the magnetic circuit of the magnetic flux loop for the second core, making it possible to reduce core loss in the second core. As it is not necessary to provide additional space in the transformer, the volume of the transformer can be reduced and the leakage magnetic flux can be reduced by tightening the magnetic coupling between the fourth winding and the second core.

The above and further objects and novel features of the invention will more fully appear from the following detailed description when the same is read in connection with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

Figure 1:
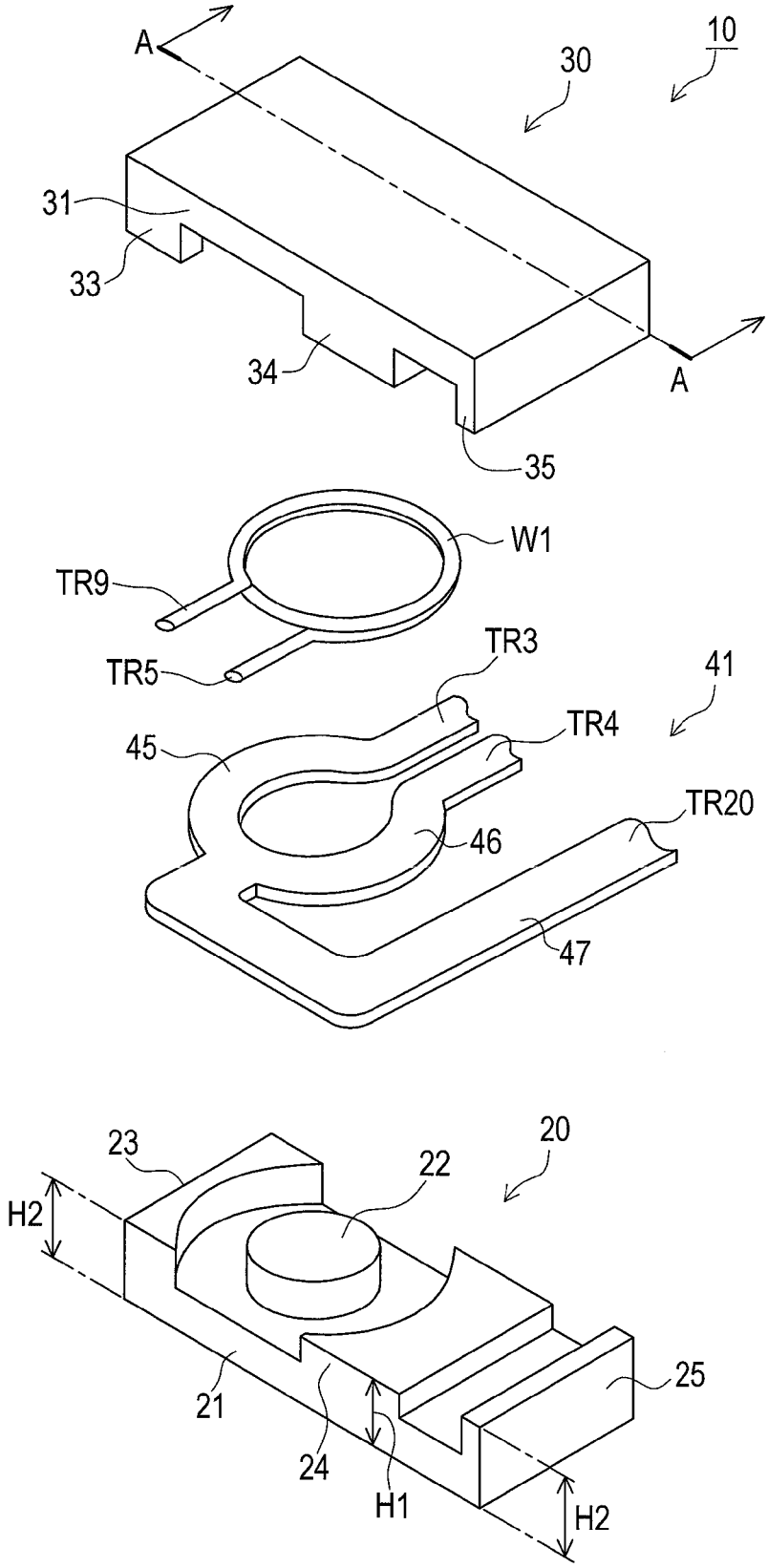
FIG. 1 is a view showing a configuration of a transformer 10.

A first embodiment of a transformer according to the invention is described below in detail with reference to FIG. 1 to FIG. 6. A transformer 10 according to the first embodiment will now be described using FIG. 1 to FIG. 3. In FIG. 1, a core 20 has a third magnetic lead 23, a first magnetic lead 22, a second magnetic lead 24 and a fourth magnetic lead 25 which are provided in parallel on a flat bottom plate 21. A height H1 of the second magnetic lead 24 is set lower than a height H2 of the first magnetic lead 22, the third magnetic lead 23 and the fourth magnetic lead 25. Similarly, a core 30 is formed of a third magnetic lead 33, a first magnetic lead 32 (not shown), a second magnetic lead 34 and a fourth magnetic lead 35 arranged on a flat bottom plate 31. The first magnetic lead 32, the third magnetic lead 33, the second magnetic lead 34 and the fourth magnetic lead 35 are all formed in the same height. The cores 20 and 30 are combined so that their magnetic leads may be opposite to each other.

A primary winding is wound onto the first magnetic leads 22 and 32 of the combined cores 20 and 30. The primary winding is wound so that a first transformer primary winding W1 is wound on the first magnetic leads 22 and 32 by a specified number of turns.

A secondary winding is composed of a coil conductor plate 41 formed of one thin conductor plate as shown in FIG. 1. The coil conductor plate 41 bifurcates at one end thereof and is provided with semicircular coils 45 and 46. An end portion of the coil 45 is referred to as terminal TR3 and an end portion of the coil 46 is referred to as terminal TR4. The other end of the coil conductor plate 41 is bent into a C-shape, and a portion wherein coils 45 and 46 are parallel with each other is referred to as coil 47. An end portion of the coil 47 is referred to as terminal TR 20.

Figure 2:
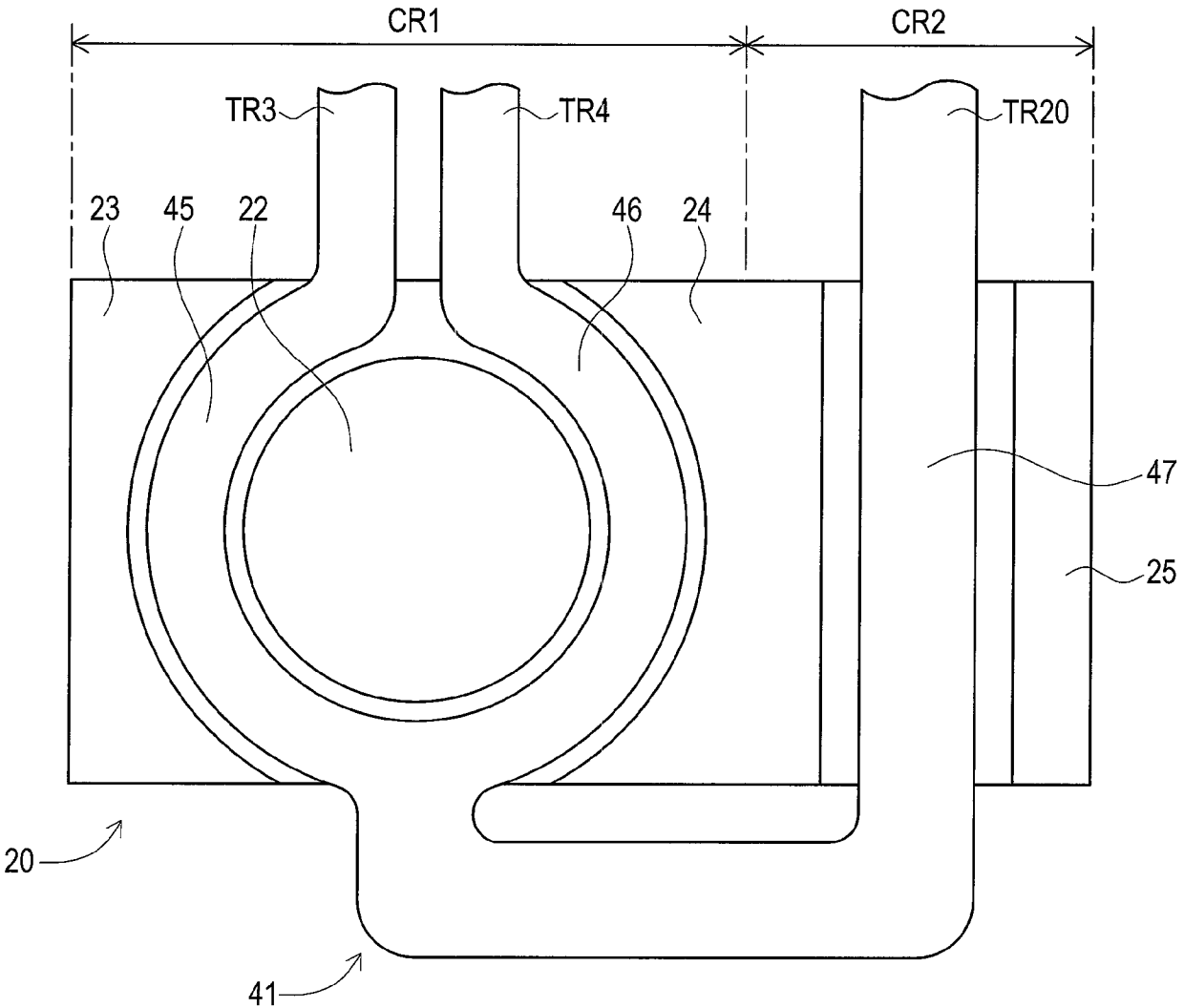
FIG. 2 is a top view of the transformer 10.

The secondary winding is wound onto the first magnetic leads 22 and 32 of the combined cores 20 and 30. Winding of the secondary winding will now be described using FIG. 2. FIG. 2 is a top view showing a combined state of the core 20 and the coil conductor plate 41. The core 20 has a first core CR1 which is composed of the first magnetic lead 22, a portion of the second magnetic lead 24 and the third magnetic lead 23. The core 20 has a second core CR2 composed of a portion of the second magnetic lead 24 and the fourth magnetic lead 25. The first core CR1 and the second core CR2 are integrally formed through the second magnetic lead 24. The coil 46 passes between the first magnetic lead 22 and the second magnetic lead 24. The coil 45 passes between the first magnetic lead 22 and the third magnetic lead 23. The coil 47 passes between the second magnetic lead 24 and the fourth magnetic lead 25. Terminals TR3, TR4 and TR20 are all provided on the same side (upper side in FIG. 2) of core 20.

As shown in FIG. 1, the assembled transformer 10 is mounted and secured to a conductor base plate not shown. Terminal TR20 and terminal TR3 are connected through a base plate or other circuit such as a rectifier circuit not shown. Terminal TR20 and terminal TR4 are connected through other circuit, in a similar manner.

The coil 45 is inserted between the third magnetic leads 23 and 33 and the first magnetic leads 22 and 32. A half turn of the secondary winding is formed by the coil 45 and the remaining half turn of the secondary winding is formed by wiring extending from terminal TR 20 to terminal TR3 through a base plate not shown. These half turn windings are combined to form a one-turn first transformer secondary winding W2. Similarly, the coil 46 is inserted between the second magnetic leads 24 and 34 and the first magnetic leads 22 and 32. A half turn of the secondary winding is formed by the coil 46 and the remaining half turn of the secondary winding is formed by wiring extending from terminal TR 20 to terminal TR4. These half turn windings are combined to form a one-turn second transformer secondary winding W4.

Figure 3:
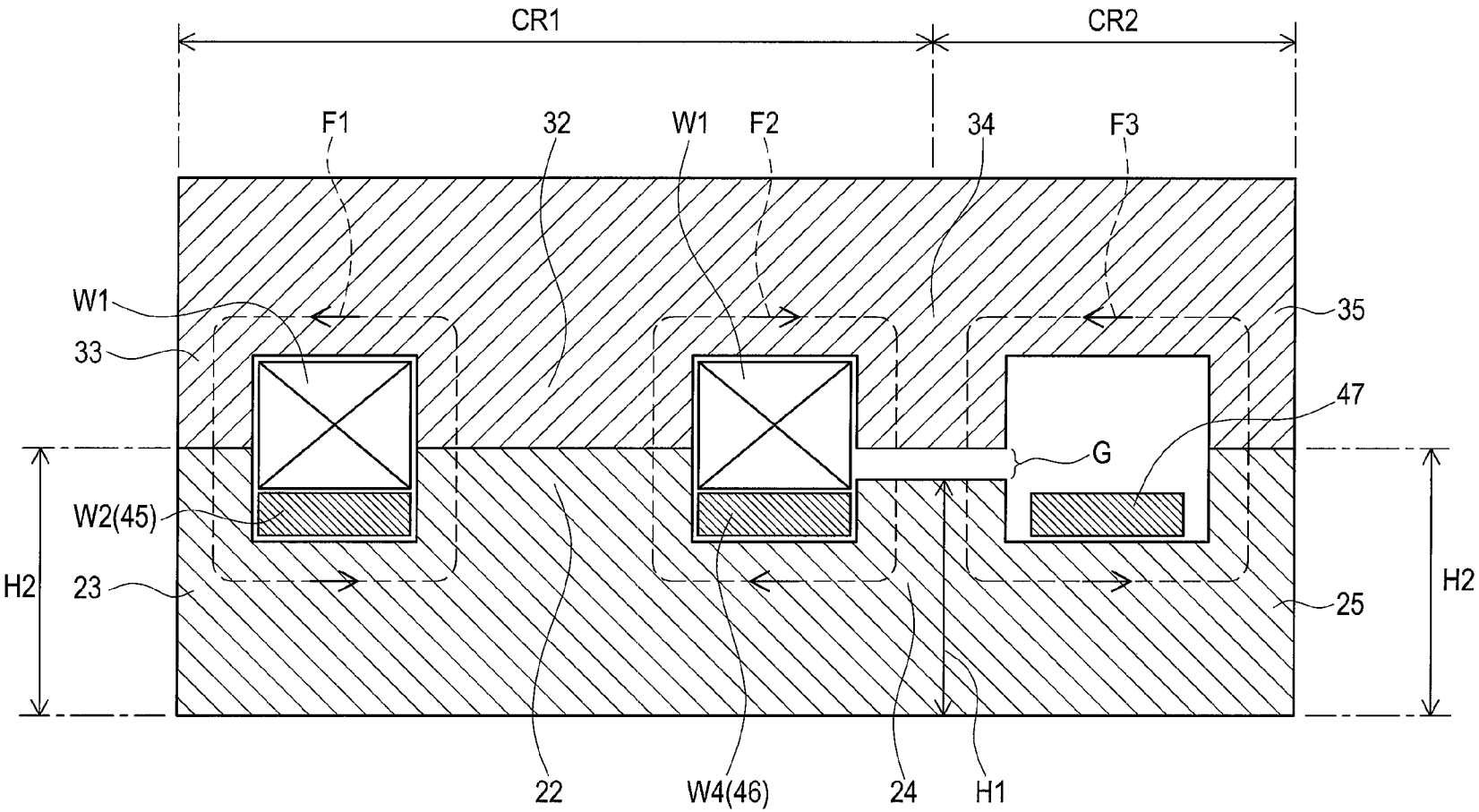
FIG. 3 is a cross section diagram of the transformer 10.

FIG. 3 shows a cross section diagram taken along an A-A line of the assembled transformer (FIG. 1). As the height H1 of the second magnetic lead 24 is set lower than the height H2 of the first magnetic lead 22, the third magnetic lead 23 and the fourth magnetic lead 25, a gap G is formed between the second magnetic leads 24 and 34. The gap G plays the role of preventing magnetic saturation of the core. On the other hand, no gap is formed between the third magnetic leads 23 and 33, between the first magnetic leads 22 and 32 and between the fourth magnetic leads 25 and 35. The first transformer primary winding W1 is enclosed between the coils 45 and 46.

The first core CR1 and the second core CR2 share the second magnetic leads 24 and 34, which means that they are formed integrally. The first core CR1 has a first magnetic flux loop F1 circling it through the first magnetic leads 22 and 32 and the third magnetic leads 23 and 33. The first core CR1 has a second magnetic flux loop F2 circling it through the first magnetic leads 22 and 32, the second magnetic leads 24 and 34 and gap G. The transformer T1 is formed by the first transformer primary winding W1 and the first transformer secondary winding W2. The transformer T2 is formed by the first transformer primary winding W1 and the second transformer secondary winding W4.

The output current Iout flowing through the coil 47 forms a third magnetic flux loop F3 in the second core CR2. The third magnetic flux loop F3 passes through the second magnetic leads 24 and 34, and the fourth magnetic leads 35 and 25. Thus, an output coil is formed equivalently on the common path of coils 45 and 46 forming the second winding.

The sectional area value of the second magnetic leads 24 and 34 is set to be equal to or higher than the total value of the sectional area of the third magnetic leads 23 and 33 and the sectional area of the fourth magnetic leads 25 and 35. Thus, a magnetic path of the second magnetic flux loop F2 and a magnetic path of the third magnetic flux loop F3 are respectively secured in the second magnetic leads 24 and 34.

The effects will be described next. First, core loss will be described. The core loss Pcv (kw/m$^3$) per unit volume of the core is determined from the magnetic flux density B and the operating frequency f. The magnetic flux density B is determined in accordance with electricity specifications and sectional area. The magnetic flux density B decreases as the sectional area S of the magnetic path becomes larger. The core loss Pcv per unit volume decreases as the magnetic flux density B becomes smaller. The volume V of the core is determined by multiplying the sectional area S by the magnetic path length R. The core loss P is determined using the following formula (I):

$$P=Pcv\times V=Pcv\times S\times R \qquad \text{formula (I)}$$

In case the inductance value for the output coil is set to a constant value, the sectional area S is also set to a constant value, as the inductance value is determined from the sectional area S. As is understood from formula (I), core loss P is determined mainly from the magnetic path length R. The core loss P can be decreased by shortening the magnetic path length R.

Figure 4:
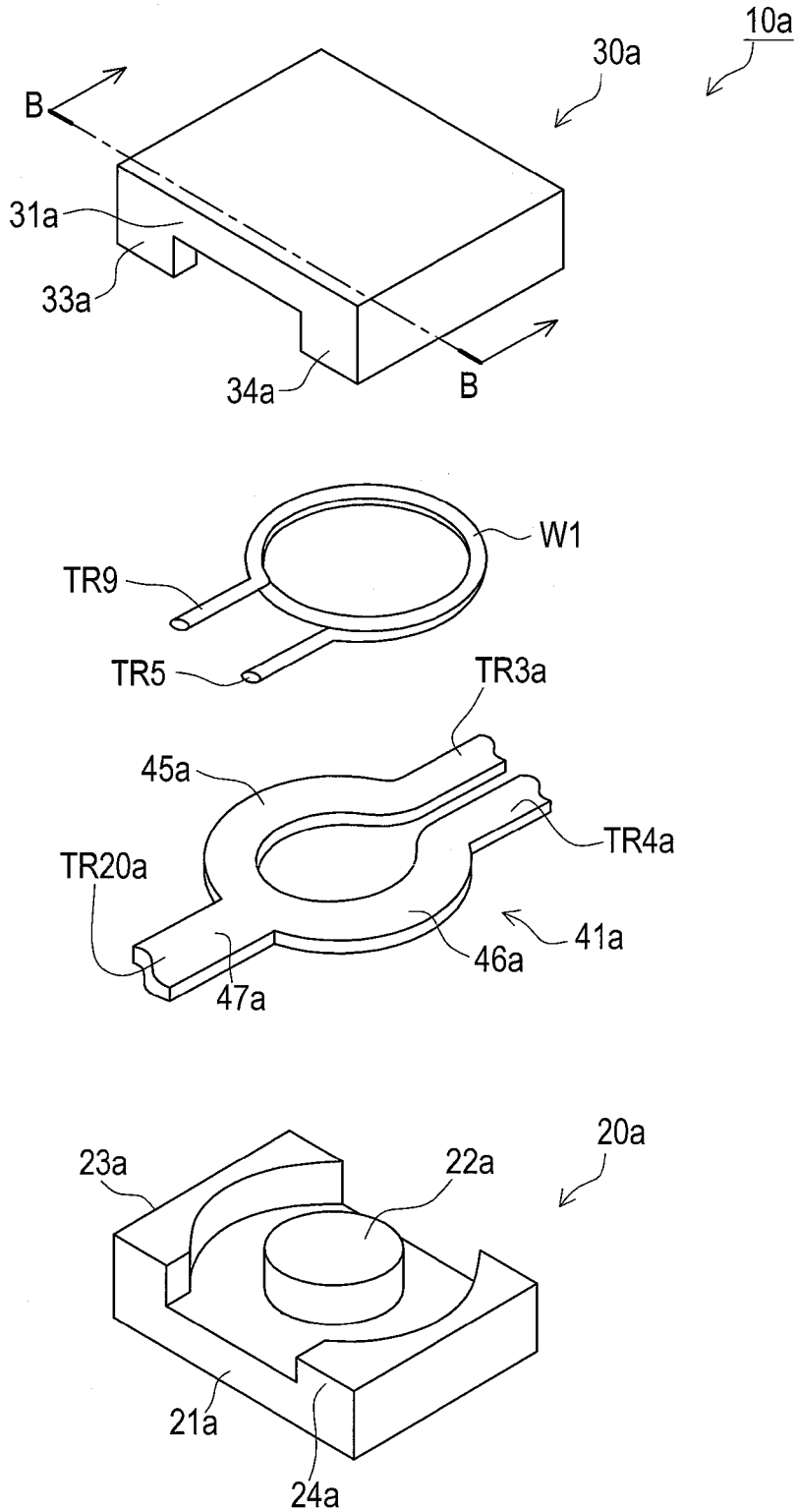
FIG. 4 is a view showing a configuration of a transformer 10*a;*

FIG. 4 shows a transformer 10*a*, which is the target of comparison, for describing the effects of the transformer 10 according to the present embodiment. A core 20*a* of the transformer 10*a* has a third magnetic lead 23*a*, a first magnetic lead 22*a* and a second magnetic lead 24*a* arranged in parallel on a flat bottom plate 21*a*. Similarly, a core 30*a* has a third magnetic lead 33*a*, a first magnetic lead 32*a* (not shown) and a second magnetic lead 34*a* arranged in parallel on a bottom plate 31*a*. A first transformer primary winding W1 is wound onto the first magnetic leads 22*a* and 32*a* of the assembled cores 20*a* and 30*a*. A secondary winding is composed of a coil conductor plate 41*a* having a linear coil 47*a*.

Figure 5:
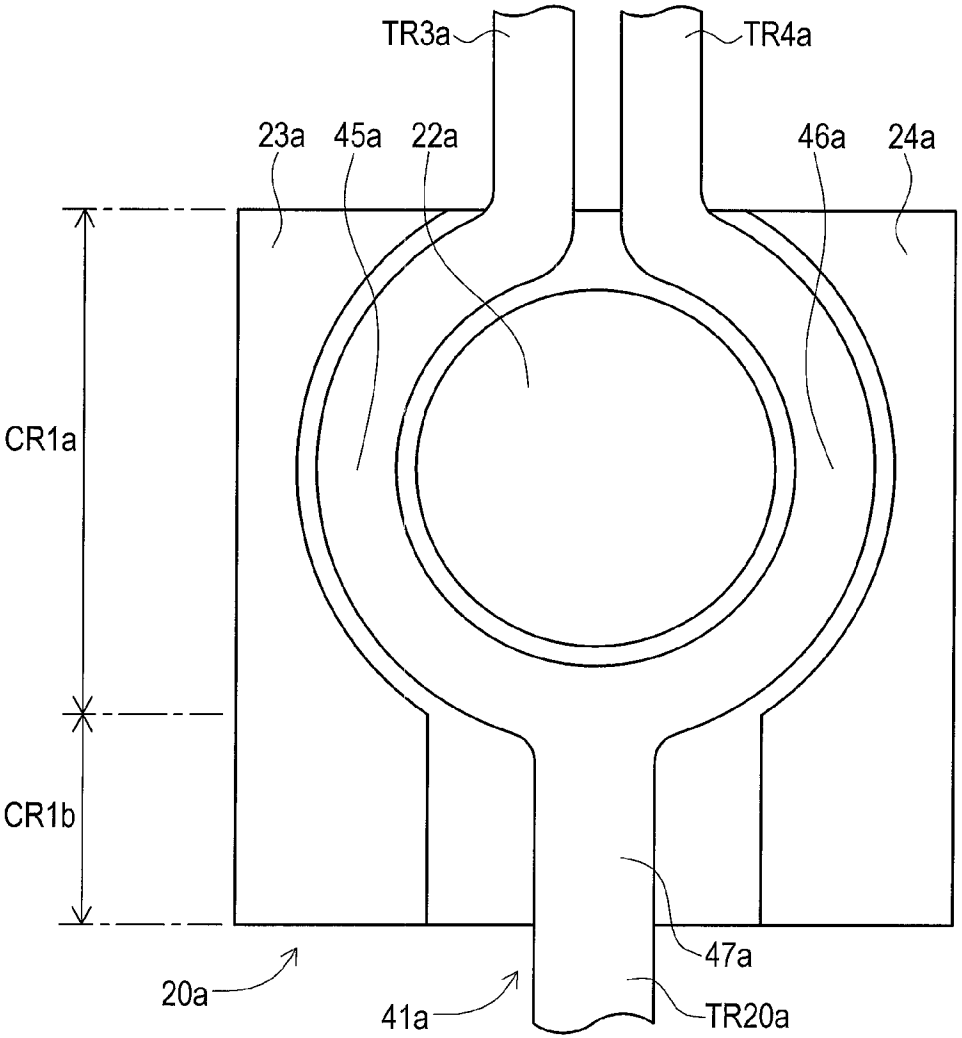
FIG. 5 is a top view of the transformer 10*a;*

FIG. 5 is a top view showing a combined state of the core 20*a* and the coil conductor plate 41*a*. The core 20*a* has a first core CR1*a* made up of the first magnetic lead 22*a*, a portion of the second magnetic lead 24*a* and a portion of the third magnetic lead 23*a*. The core 20*a* has a first core CR1*b* made up of a portion of the third magnetic lead 23*a* and a portion of the second magnetic lead 24*a*. The first core CR1*a* and the first core CR1*b* are formed integrally.

The coil 47*a* of the coil conductor plate 41*a* passes between the third magnetic lead 23*a* and the second magnetic lead 24*a*. Terminals TR3*a* and TR4*a* are provided on one side of the core 20*a*, terminal TR20*a* is provided on the other side of the core 20*a*.

Figure 6:
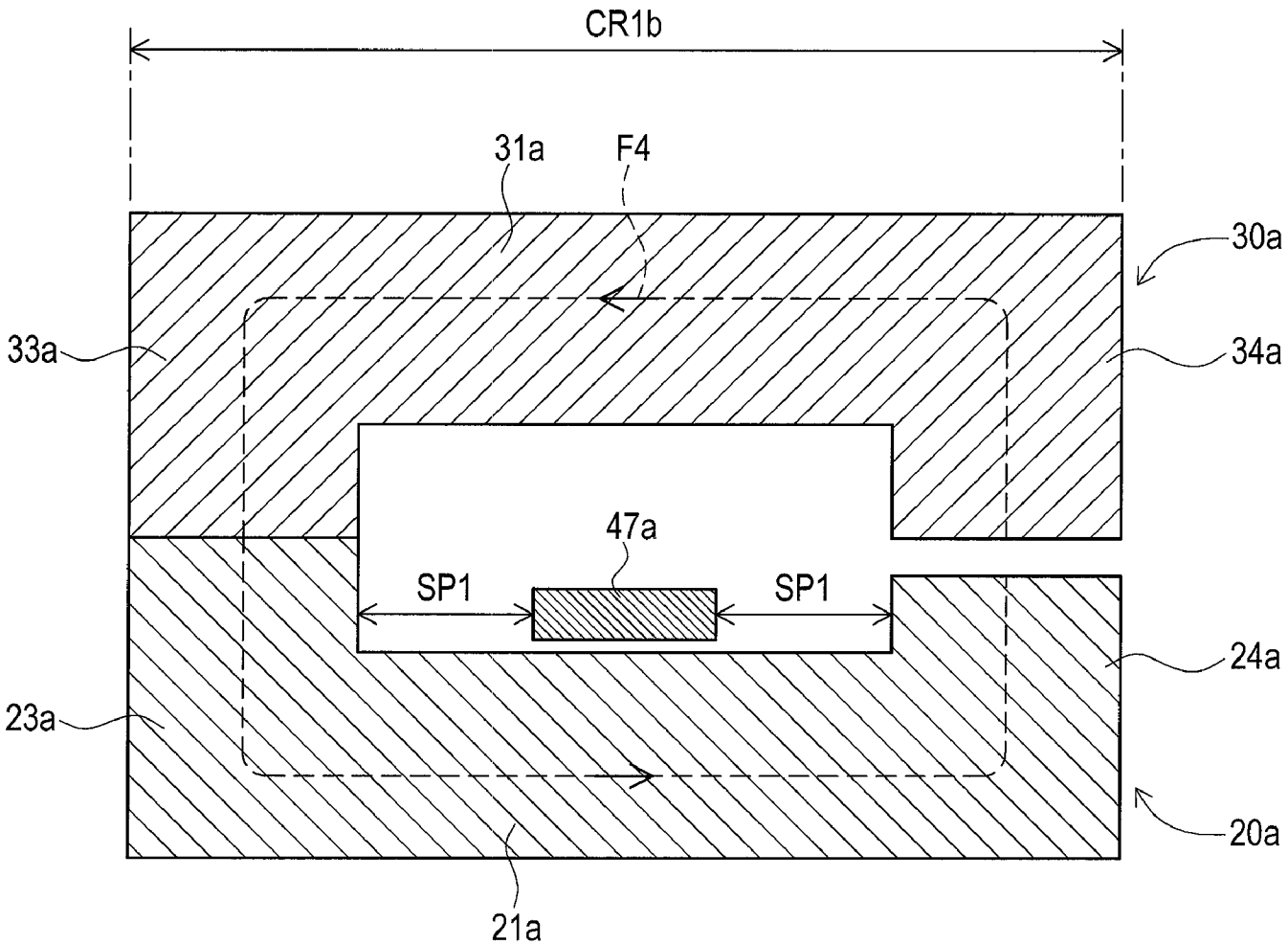
FIG. 6 is a cross section diagram of the transformer 10*a;*

FIG. 6 is a cross sectional diagram taken along a B-B line of FIG. 4. As shown in FIG. 6, the output current Iout flowing through the coil 47*a* forms a fourth magnetic flux loop F4 in the cores 20*a* and 30*a*. The fourth magnetic flux loop F4 passes through the bottom plate 21*a*, the second magnetic leads 24*a* and 34*a*, the bottom plate 31*a* and the third magnetic leads 33*a* and 23*a*. As a result, an output coil is equivalently formed on a common path of the coils 45*a* and 46*a* that form the second winding.

Here, the magnetic path length of the third magnetic flux loop F3 in the transformer 10 will be compared to the magnetic path length of the fourth magnetic flux loop F4 in the transformer 10*a*. The magnetic path length of the third magnetic flux loop F3 is shorter than the magnetic path length of the fourth magnetic flux loop F4 by 4 times the space SP1 (FIG. 6) exiting at the left and right of the coil 47*a*. Here, space SP1 is required for extracting terminal TR5 and terminal TR9 (FIG. 4) of the first transformer primary winding W1. The magnetic path length R can be made shorter in the formula (I) in the case that the output coil is formed using the second core CR2 (FIG. 2) as compared to the case that the output coil is formed using the first core CR1*b* (FIG. 6). This makes it possible to reduce core loss P.

As was described in detail in the above text, according to the transformer 10 in the first embodiment, the output coil can be composed of a coil 47 and the second core CR2 and is formed integrally with the transformer. As it is no longer necessary to use an independent coil element as an output coil, the number of elements can be reduced.

As the second core CR2 is used only by the coil 47, excess space such as space SP1 need no longer be provided in the first core CR1*b* (FIG. 6). This makes it possible to optimize the shape of the second core CR2 to match the coil 47. As the magnetic path length of the third magnetic flux loop F3 can be shortened, the core loss in the second core CR2 can be reduced. As it is no longer necessary to provide excess space, the volume of the transformer 10 can be further reduced and the leakage magnetic flux can be reduced by tightening the magnetic coupling between the coil 47 and the second core CR2.

Terminals TR3, TR4 and TR20 of the coil conductor plate 41 are all provided in the same side (right side in FIG. 1) of the transformer 10. Thus, when forming the secondary winding by connecting the wiring to terminals TR3, TR4 and TR20 of the coil conductor plate 41, the wiring may be connected to the same side of the transformer 10. Specifically, the wiring does not have to be connected to both sides of the transformer 10, which helps simplify the wiring layout. This makes it possible to reduce the mounting surface of the transformer 10.

In the cores 20 and 30, the value of the sectional area of the second magnetic leads 24 and 34 is set to a value which is equal to or higher than a total value of the sectional area of the third magnetic leads 23 and 33 and the sectional area of the fourth magnetic leads 25 and 35. Thus, a magnetic path of the second magnetic flux loop F2 and a magnetic path of the third magnetic flux loop F3 are respectively secured in the second magnetic leads 24 and 34. It is thus possible to prevent the magnetic flux density of the second magnetic leads 24 and 34 from becoming higher than the magnetic flux density of the third magnetic leads 23 and 33 and fourth magnetic leads 25 and 35. This makes it possible to prevent the core loss from becoming higher.

Figure 7:
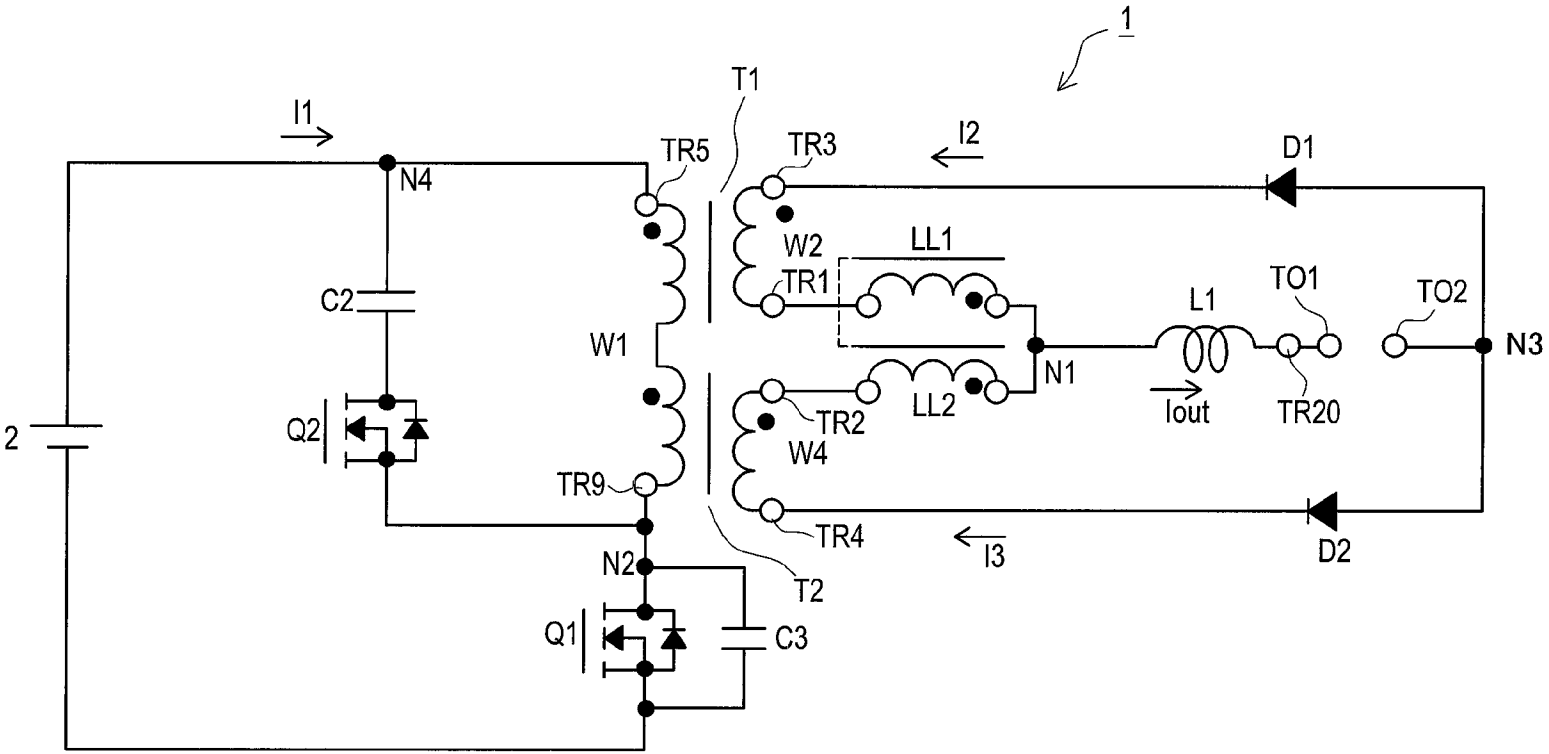
FIG. 7 is a circuit diagram of a DC-DC converter 1.

A second embodiment of the present invention will now be described using FIG. 7. FIG. 7 is a circuit diagram of a step-down DC-DC converter 1 using the transformer 10 according to the first embodiment. As was already described in the first embodiment 1, the transformer T1 is formed of a coil 46, first magnetic leads 22 and 23 and second magnetic leads 24 and 34. In turn, the transformer T2 is formed of a coil 45, first magnetic leads 22 and 32 and third magnetic leads 23 and 33.

A primary side of the DC-DC converter 1 will now be described. Terminal TR5 of a first transformer primary winding W1 is connected to a positive electrode of an input power supply 2. Terminal TR9 of the first transformer primary winding W1 and a drain terminal of a switching element Q1 composed of a NMOS transistor are connected through a node N2. A capacitor C3 is connected in parallel with the switching element Q1. One end of a capacitor C2 is connected to a node N4, and the other end thereof is connected to a drain terminal of the switching element Q2. A source terminal of the switching element Q2 is connected to the node N2.

A secondary side of the DC-DC converter 1 will be described next. At the secondary side are provided a first transformer secondary winding W2 and a second transformer secondary winding W4, diodes D1 and D2, output coils L1, LL1 and LL2, and output terminals TO1 and TO2. The first transformer secondary winding W2 has terminals TR1 and TR3. The second transformer secondary winding W4 has terminals TR2 and TR4. When the switching element is in a conductive state, a negative electromotive force is generated in terminal TR1 and terminal TR4, and a positive electromotive force is generated in terminal TR2 and terminal TR3. The first transformer secondary winding W2 and the second transformer secondary winding W4 are connected in series through the output coils LL1 and LL2, so that the dot marks are in the same direction.

A cathode terminal of the diode D1 is connected to terminal TR3 and a cathode terminal of the diode D2 is connected to terminal TR4. The anode terminals of the diode D1 and D2 are connected in common through a node N3. The current path shared between the transformer T1 and the transformer T2 is formed with terminals TR1 and TR2 as a start point and the node N3 as an end point. The output coils L1, LL1 and LL2 and the output terminals TO1 and TO2 are provided on the current path. In the transformer 10 described in the first embodiment, the output coils L1, LL1 and LL2 equivalently show a coil component formed by the second core CR2 and the coil 47. One end of the output coil LL1 is connected to terminal TR1 and one end of the output coil LL2 is connected to terminal TR2. The other terminals of the output coils LL1 and LL2 are connected in common through a node N1. The output coils LL1 and LL2 are combined with each other so that the dot marks showing polarity are on the node N1 side. One end of the output coil L1 is connected to the node N1 and the other end thereof is connected to the output terminal TO1 through terminal TR20.

The circuit operation in the DC-DC converter 1 will now be described while referring to FIG. 7. For the sake of simplicity of description, first, the operation of the transformer resetting circuit having the capacitor C2 and the switching element Q2 will be omitted in the following description.

In the first place, a description will be given concerning the operation of the switching element Q1 in a conductive state. The operation of the transformer T1 will now be described. When a high level signal is inputted to the gate terminal of the switching element Q1, and the switching element Q1 becomes conductive, a positive voltage is applied to the dot mark-side of the first transformer primary winding W1 in the transformer T1. At this time, a positive voltage is generated at terminal TR3 on the dot mark-side of the first transformer secondary winding W2, and a negative voltage at terminal TR1 on the node N1 side. As a result, since a reverse bias voltage is applied to the diode D1, no current flows in the first transformer secondary winding W2.

When the switching element Q1 is in a conductive state, a positive voltage is applied to the dot mark-side of the first transformer primary winding W1 in the transformer T2. At this time, a positive voltage is generated at terminal TR2 on the dot mark-side of the second transformer secondary winding W4, and a negative voltage at terminal TR4 on the opposite side of the dot mark. As a result, since a forward bias voltage is applied to the diode D2, current I3 flows in the second transformer secondary winding W4. As current I3 is supplied to the output terminals TO1 and TO2 by way of the output coils L1 and LL2, energy is accumulated inside the output coils L1 and LL2.

When the switching element Q1 is in a non-conductive state, the operation of the DC-DC converter 1 is as follows. The operation of the transformer T1 will now be described. A low level signal is inputted to the gate terminal of the switching element Q1, and at the moment when the switching element Q1 shifts from a conductive state to a non-conductive state, the direction and intensity of the magnetic field is kept the same. Therefore, in order to keep the same ampere-turn as the current I1 flowing in the first transformer primary winding W1, a negative voltage is generated at terminal TR3 on the dot mark side of the first transformer secondary winding W2, and a positive voltage at terminal TR1 on the node N1 side. Thus, as a forward bias voltage is applied to the diode D1, and the first rectifier element is in the conductive state, current I2 flows and energy accumulated in the transformer T1 is supplied to the output terminals TO1 and TO2.

Also when the switching element Q1 is in a non-conductive state, at the transformer T2 side, a negative voltage is generated at terminal TR2 on the dot mark side of the second transformer secondary winding W4 and a positive voltage at terminal TR4 on the opposite side of the dot mark. Therefore, a reverse bias voltage is applied to the diode D2, preventing power from being transmitted from the primary side through the transformer T2. When the switching element Q1 is in a non-conductive state, a counter-electromotive force is generated in the output coil L1, being positive at the output terminal T01 side, and negative at the node N1 side. Herein, since the output coil L1 is provided on the common path of the diode D1 and the diode D2, energy can be released through the diode D1 even if the diode D2 is in a non-conductive state. Hence, due to this counter-electromotive force, a current further flows into the output terminal through the diode D1, and the energy accumulated in the output coil L1 is released to the output side. Similarly, the energy accumulated in the output coil LL2 is also released to the output side.

At the transformer T1 side, when the switching element Q1 is in a conductive state, energy is accumulated in the transformer T1 and when the switching element Q1 is in a non-conductive state, the energy accumulated in the transformer T1 is released. Thus, a flyback operation is carried out. Also, at the transformer T2 side, when the switching element Q1 is in a conductive state, energy is transmitted in the transformer T2 and when the switching element Q1 is in a non-conductive state, the energy accumulated in the output coils L1 and LL2 is released. Thus, a forward operation is carried out.

Next, the operation of a transformer resetting circuit having the capacitor C2 and the switching element Q2 is described with reference to FIG. 7. In the transformer T2 wherein the forward operation is carried out, when the switching element Q1 is in the non-conductive state while some energy has still remained in the first transformer primary winding W1, current flows into the capacitor C2 through the switching element Q2, and the energy in the first transformer primary winding W1 is released. As a result, the magnetic flux direction of the first transformer primary winding W1 is inverted, enabling reset of the core of the transformer T2. In relation to the operation of the second core of the transformer T2, the amount of excitation of the switching element Q1 while in an ON state is equal to the resetting amount of switching element Q2 while in an ON state.

According to the detailed description in the above text, in the DC-DC converter 1 according to the present embodiment, the operation of the transformer T1 can be assigned to the flyback operation and the operation of the transformer T2 is assigned to the forward operation. In the transformer T2 wherein the forward operation is carried out, the energy simply passes through the transformer but does not have to be accumulated therein. Thus, as it is not necessary to increase the saturation current, the core gap can be dispensed with. As compared with the prior art requiring gaps both in transformer T1 and transformer T2, in the invention, the gap is required only in the transformer T1. The number of gaps can be decreased in the overall transformer, or the total length value of the gap distance can be reduced.

Hence, in the transformers T1 and T2, excitation current due to gaps can be decreased, and the loss can be reduced. It is also possible to reduce the leakage magnetic flux flowing from gaps, and the transformer can be prevented from generating heat due to loss by eddy current. As a heat transfer property in the core is improved in a gap-free portion, the number of components used as countermeasure against heat release can be decreased or dispensed with.

Figure 8:
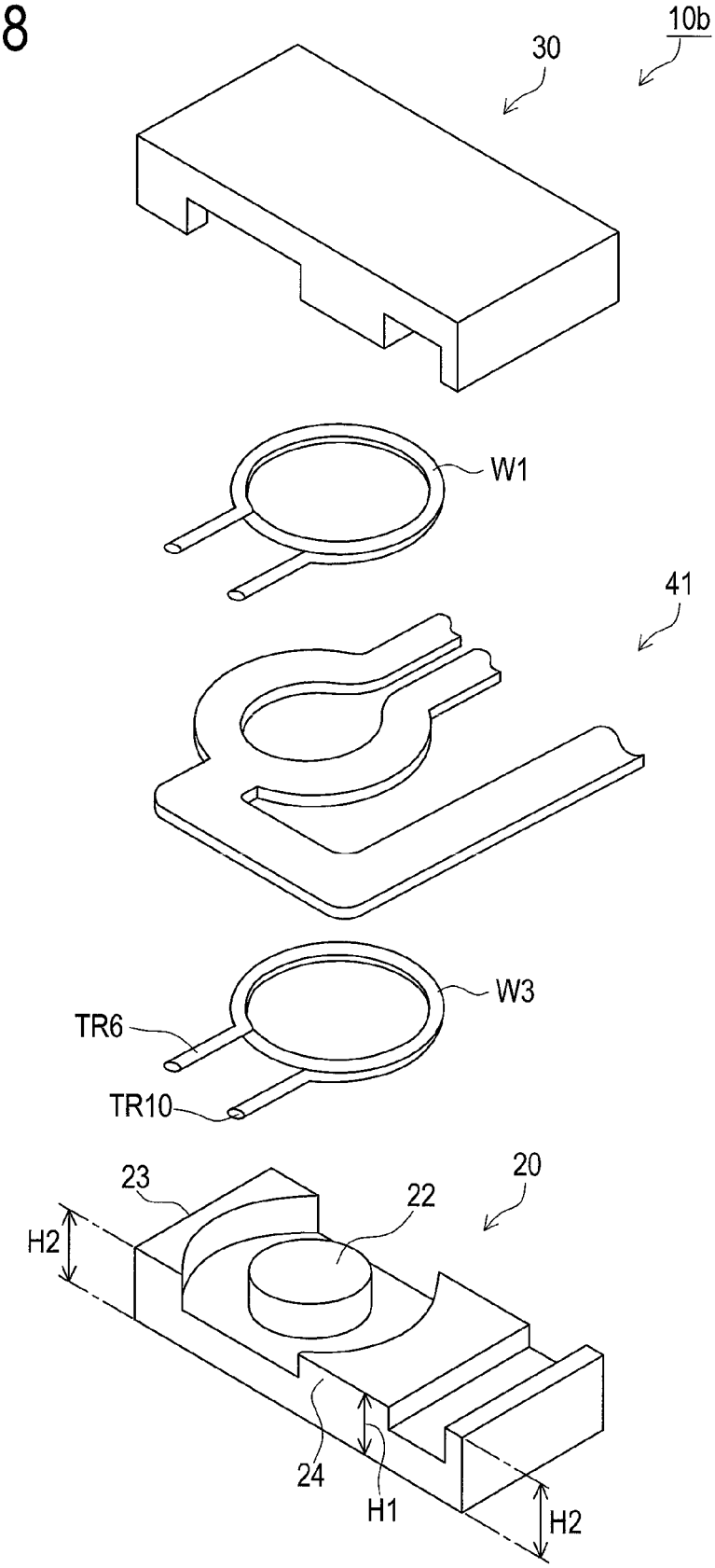
FIG. 8 is a view showing a configuration of a transformer 10*b;*

A third embodiment of the present invention will now be described using FIG. 8 and FIG. 9. FIG. 8 shows a transformer 10*b* according to the third embodiment. The transformer 10*b* also includes a second transformer primary winding W3 in addition to the configuration of the transformer 10 (FIG. 1) according to the first embodiment. The second transformer primary winding W3 is wound around first magnetic leads 22 and 32 by a specified number of turns. A coil conductor plate 41 is enclosed between a first transformer primary winding W1 and the second transformer primary winding W3. The other aspects are similar to the transformer 10 according to the first embodiment, and therefore a detailed description thereof is hereby omitted.

Figure 9:
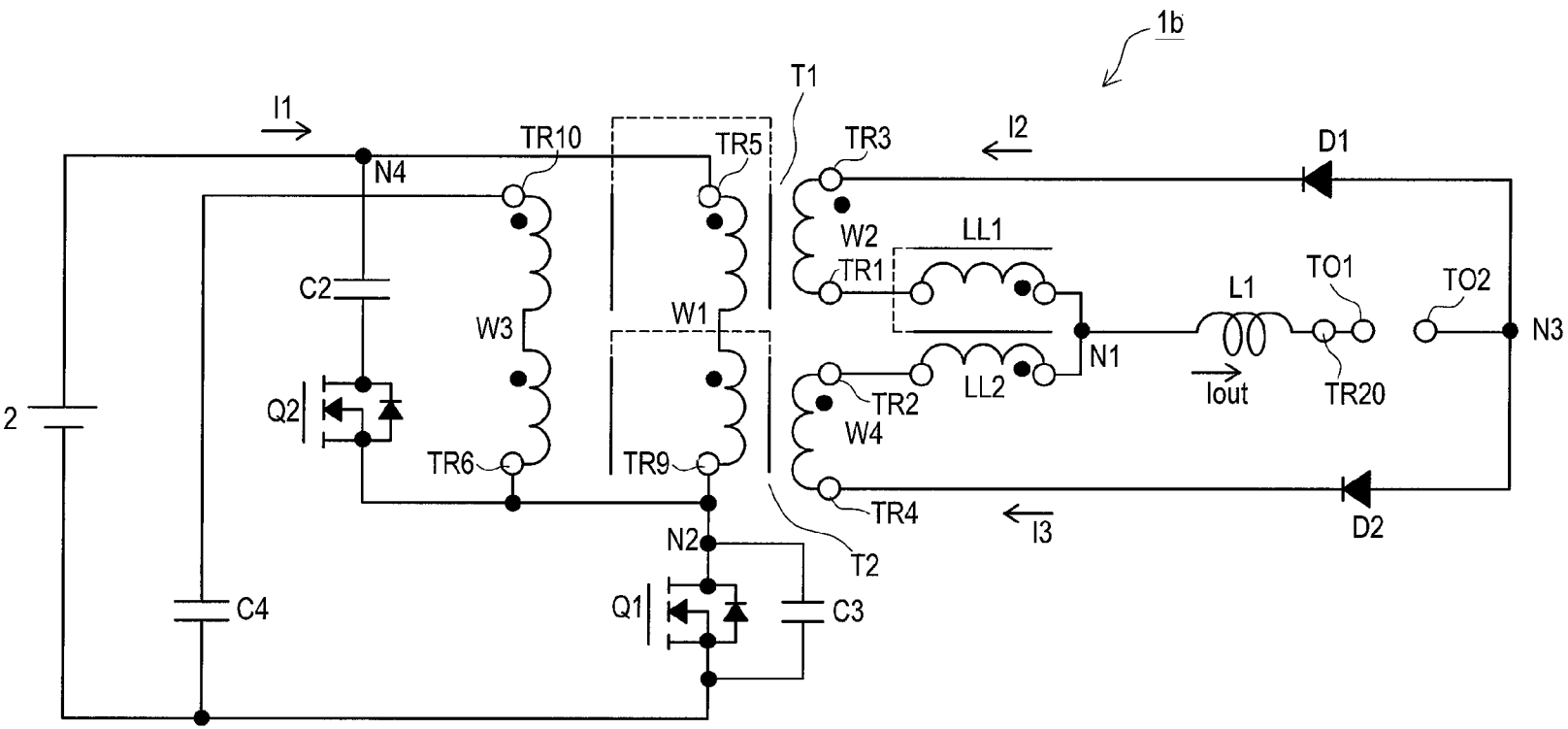
FIG. 9 is a circuit diagram of a DC-DC converter 1*b;*

FIG. 9 is a circuit diagram of a step-down DC-DC converter 1*b* using the transformer 10*b* according to the third embodiment. Next, the primary side of the DC-DC converter 1*b* will be described. The DC-DC converter 1*b* further includes a second transformer primary winding W3 and a smoothing capacitor C4, in addition to the configuration of the DC-DC converter 1 according to the second embodiment (FIG. 7). Terminal TR6 of the second transformer primary winding W3 is connected to a node N2. One end of the capacitor C4 is connected to the negative electrode of an input DC power supply 2 and a source terminal of the switching element Q1, and the other end thereof is connected to terminal TR10 of the second transformer primary winding W3. The other aspects are similar with those of the DC-DC converter 1 according to the second embodiment, and therefore, a detailed description thereof is hereby omitted.

Next, a description will be given concerning the operation in a circuit having the second transformer primary winding W3 and the capacitor C4 and adapted to continuously supply current in the primary side of the transformer. When the switching element Q1 is in a non-conductive state, the capacitor C4 is charged from the input DC power supply 2 through the first transformer primary winding W1 and the second transformer primary winding W3. At this time, opposite magnetic fluxes are generated in the first transformer primary winding W1 and the second transformer primary winding W3, and these magnetic fluxes are canceled out. The path from the input DC power supply 2 to the capacitor C4 is equivalent to a conducting wire. If the switching element Q1 is in a non-conductive state, the capacitor C4 is charged by the input DC power supply 2. Alternatively, if the switching element Q1 is in a conductive state, current flows from the input DC power supply 2 to the first transformer primary winding W1, and at the same time, current also flows from the capacitor C4 to the second transformer primary winding W3.

Effects will be described next. If the second transformer primary winding W3 and the capacitor C4 are not provided, current does not flow from the input DC power supply 2 when the switching element Q1 is in a non-conductive state. As a result, the current on the primary side is discontinued, which generates noise. However, in the DC-DC converter 1*b* according to the present invention, charge current flows from the input DC power supply 2 to the capacitor C4 even if the switching element Q1 is in a non-conductive state. Thus, current flows from the input DC power supply 2 both when the switching element Q1 is conductive and non-conductive. This prevents discontinuity in primary-side current and at the same time makes it possible to decrease the peak value of the primary-side current. Thus, ripples of the input current can be reduced.

Figure 10:
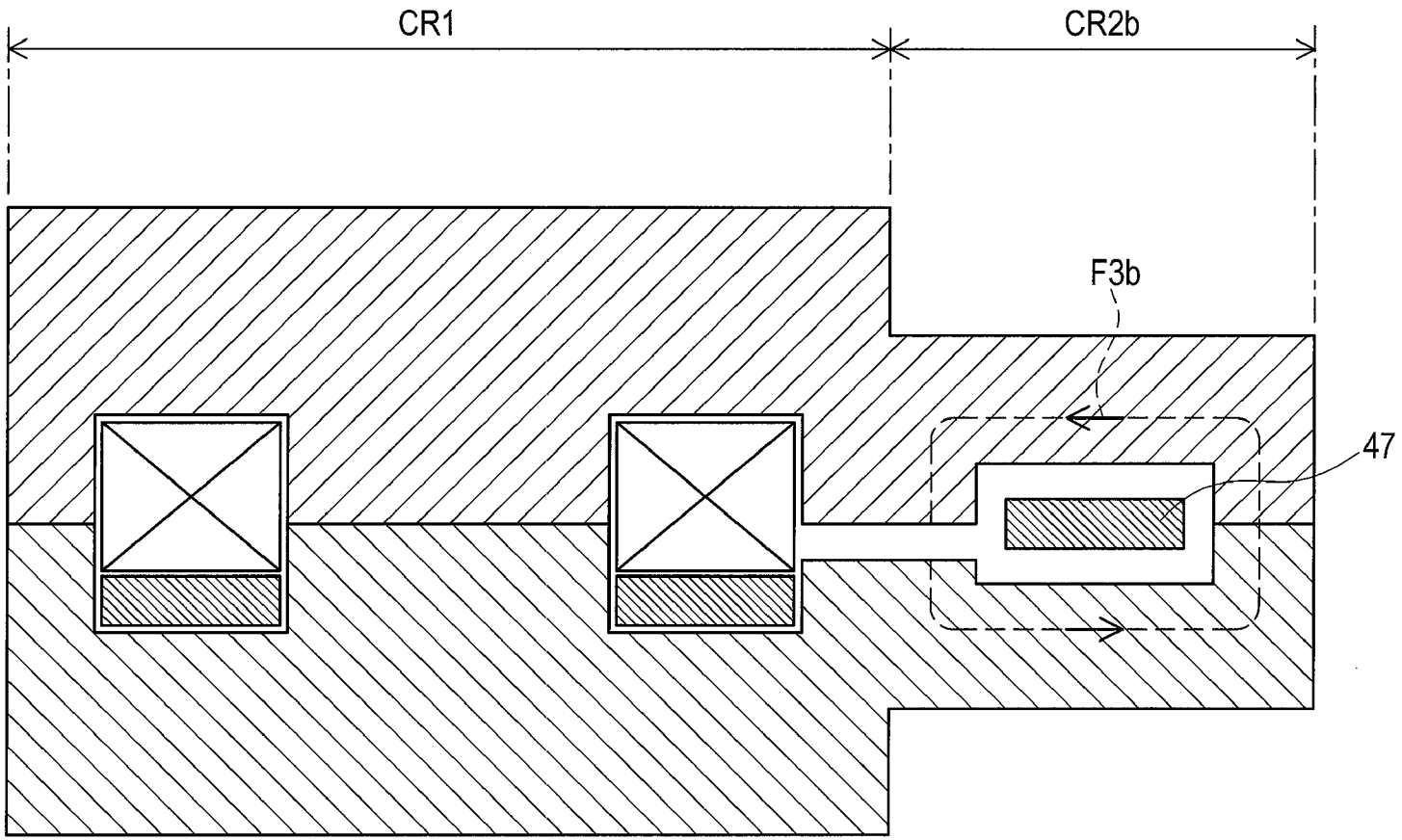
FIG. 10 is a view showing a modified example of a transformer (part 1)

The invention is not limited to the above-described embodiments, but may be changed and modified within a scope not departing from the true spirit of the invention. In the cross-sectional diagram of the transformer 10 according to the first embodiment (FIG. 3), a description was given wherein the first core CR1 and the second core CR2 have the same core height and are integrated. However, this is not limited to this aspect alone. As shown in FIG. 10, it may be possible to use a second core CR2*b* which has a lower core height than the first core CR1. As the second core CR2*b* is for use in the coil 47, the shape of the second core CR2*b* can be optimized to match the coil 47. Thus, the length of the magnetic path of a third magnetic flux loop F3*b* formed in the second core CR2*b* can be shortened by the amount the core height is shortened in comparison with the magnetic path length of the third magnetic flux loop F3 (FIG. 3) of the second core CR2. This makes it possible to reduce core loss. Thus, the volume of the second core CR2*b* can be further reduced. At the same time, the leakage magnetic flux can be reduced by tightening the magnetic coupling between the coil 47 and the second core CR2*b*.

Figure 11:
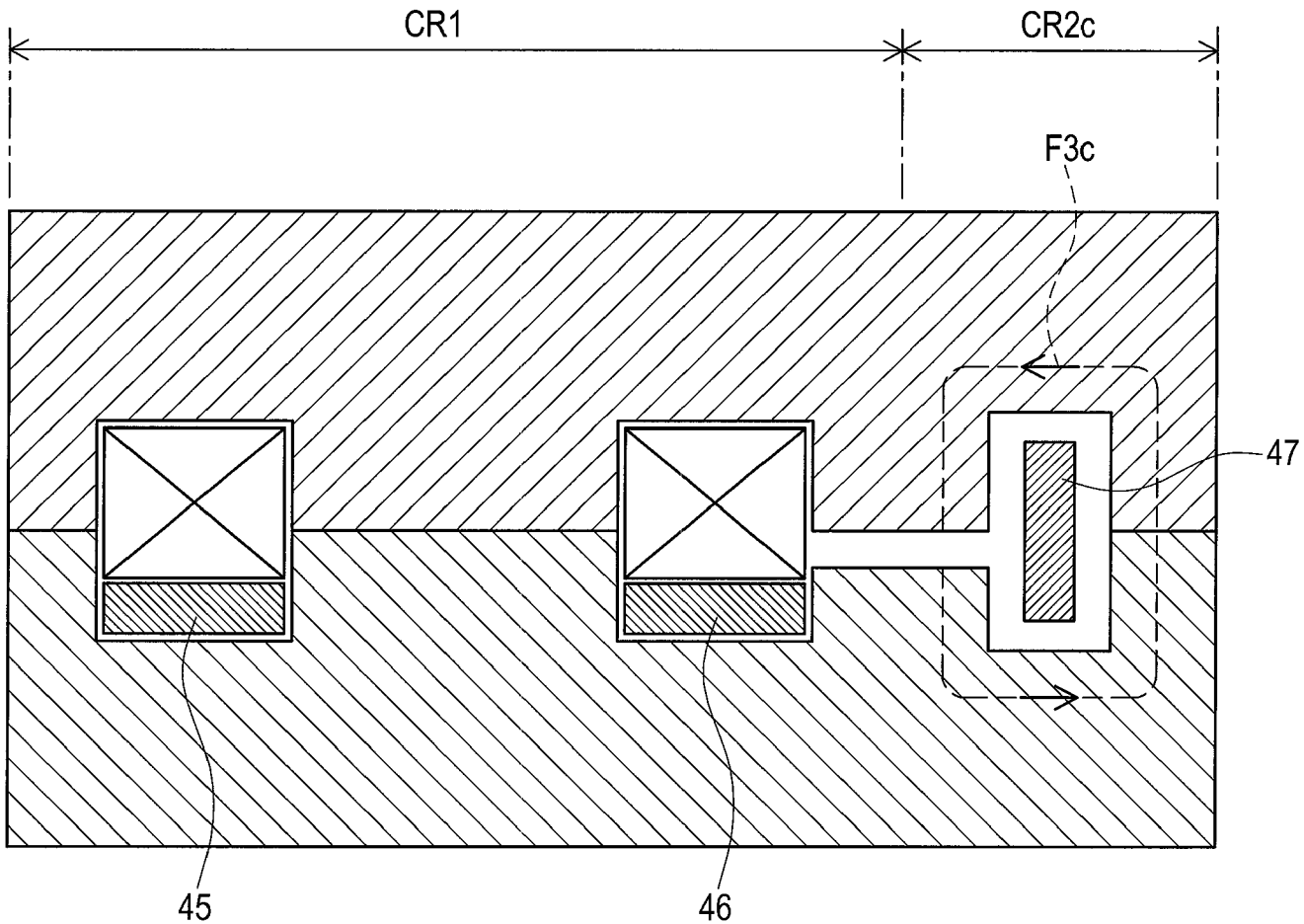
FIG. 11 is a view showing a modified example of the transformer (part 2) and FIG. 12 is a view showing a configuration of a conventional transformer core.
Figure 12:
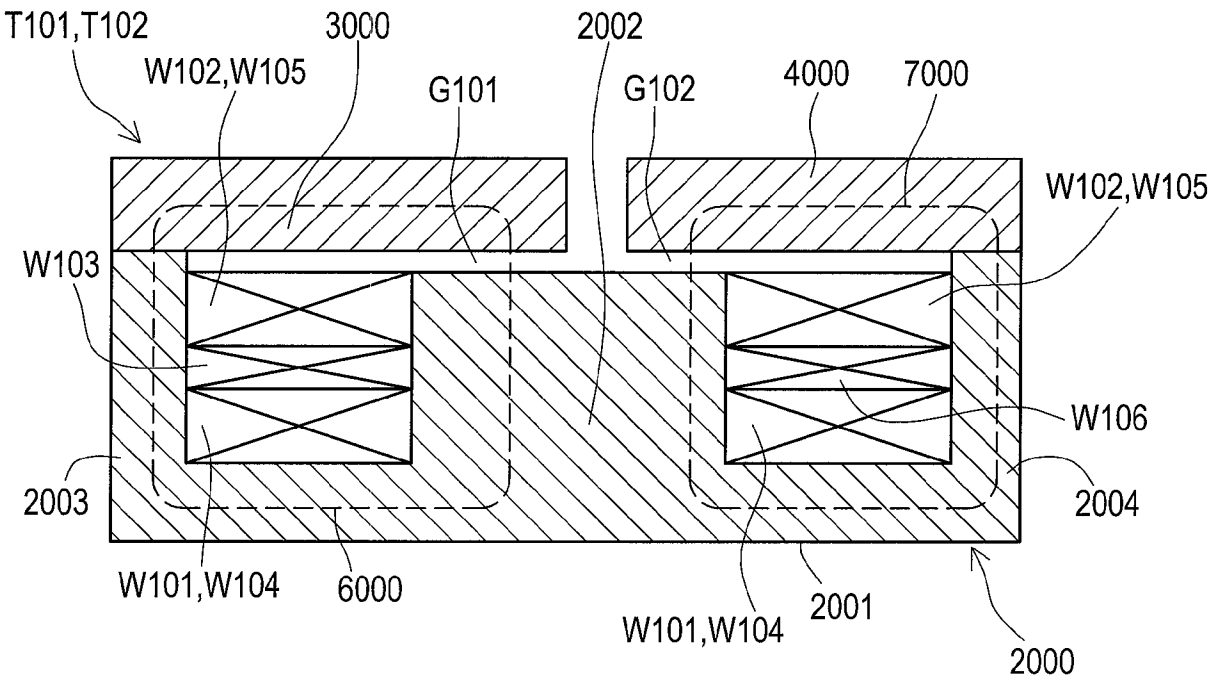
FIG. 12 Prior Art

As shown in FIG. 11, the coil 47 may be rotated by 90° with respect to the coils 45 and 46. At the same time, the shape of a second core CR2*c* may be changed to match the coil 47. Thus, the core width of the second core CR2*c* can be reduced. Thus, the magnetic path length of a third magnetic flux loop F3*c* formed in the second core CR2*c* can be made shorter by the amount the core width is reduced, as compared to the magnetic path length of the third magnetic flux loop F3 (FIG. 3) of the second core CR2. This makes it possible to reduce core loss. Thus, the volume of the second core CR2*c* can be further reduced. At the same time, the leakage magnetic flux can be reduced by tightening the magnetic coupling between the coil 47 and the second core CR2*c*.

In the second embodiment (FIG. 7) and third embodiment (FIG. 9), a description was given wherein the cathode terminal of the diode D1 is connected to terminal TR3, the cathode terminal of the diode D2 is connected to terminal TR4 and the anode terminals of the diodes D1 and D2 are connected in common to the node N3. However, this is not limited to this aspect only. For instance, a connected state of the secondary side as shown in FIG. 7 and FIG. 9 can also be changed to a state wherein the polarity of the diodes D1 and D2 is inversed. Thus, a forward operation is carried out in the transformer T1 side and a flyback operation is carried out on the transformer T2 side. In this case as well, the effects of the invention can be achieved.

In the third embodiment (FIG. 9), a description was given wherein one end of the capacitor C2 is connected to the positive electrode of the input DC power supply 2 and terminal TR5 of the first transformer primary winding W1 through the node N4. However, this is not limited to this aspect. For instance, a connected state of the primary side as shown in FIG. 9 can also be changed to a state wherein one end of the capacitor C2 is connected in common to terminal TR10 of the second transformer primary winding W3 and one end of the capacitor C4. In the present embodiment, an effect of resetting the core of the transformer T2 wherein the forward operation is carried out can be achieved in the capacitor C2.

A circuit wherein transformer 10 according to the first embodiment can be applied is not limited to a DC-DC converter as shown in the second embodiment. Such a circuit can also be applied to a full bridge-type DC-DC converter or other various types of circuits.

The transformer 10 according to the first embodiment may be formed by integrating two transformers including a first transformer, a second transformer, and an output coil. However, this is not limited to this aspect. The transformer 10 may also include one transformer and the output transformer which are integrated.

The transformer according to one aspect comprising: a pair of bottom plates arranged substantially parallel to each other; a first magnetic lead and a second magnetic lead arranged at a center part of the bottom plates with a predetermined space therebetween; a third magnetic lead provided outside the first magnetic lead; and a fourth magnetic lead provided outside the second magnetic lead; wherein: the first core is formed by the first magnetic lead through the third magnetic lead; and the second core is formed by the second magnetic lead and the fourth magnetic lead.

Thus, the first core and the second core can be formed integrally and share the second magnetic lead. The magnetic path of the magnetic flux loop for the output coil can be formed and optimized through the second magnetic lead, the fourth magnetic lead and the bottom plate. The magnetic path of the magnetic flux loop of the output coil can thus be shortened, making it possible to reduce core loss.

The transformer according to one aspect comprising: a conductor plate, with one end thereof bifurcating to form the second winding and the third winding, and other end thereof forming the fourth winding; wherein: the second winding passes through between the first magnetic lead and the second magnetic lead; the third winding passes through between the first magnetic lead and the third magnetic lead; and the fourth winding passes through between the second magnetic lead and the fourth magnetic lead.

The first transformer is formed through a first magnetic lead, a second magnetic lead, a first winding and a second winding. The second transformer is formed through a first magnetic lead, a third magnetic lead, a first winding and a second winding. The output coil is formed through a second magnetic lead, a fourth magnetic lead and a fourth winding. The magnetic path of the magnetic flux loop for the output coil can be formed and optimized by forming the output coil using the second magnetic lead, the fourth magnetic lead and the fourth winding. As the magnetic path of the magnetic flux loop of the output coil can be shortened, core loss can be reduced.

The transformer according to one aspect, wherein end portions of the second winding through the fourth winding are all arranged in a same side of the transformer.

If various types of wiring are connected to the second winding through the fourth winding, the wiring may be connected to the same side of the transformer. Specifically, the wires do not need to be connected to both sides of the transformer, which makes it possible to simplify the wiring layout. Thus, the mounting surface of the transformer can be reduced.

The transformer according to one aspect, wherein either one of the second magnetic lead and the third magnetic lead has a gap; other one of the second magnetic lead and the third magnetic lead either has a gap which is narrower than said gap, or is gap-free.

The gaps provided in the core are used for increasing the magnetic resistance of the core and decreasing inductance. This makes it possible to set the inductance of the first transformer and the inductance of the second transformer to different values.

If the second magnetic lead has gaps and the third magnetic lead either has gaps which are narrower than the gaps in the second magnetic lead or is gap-free, the inductance of the first transformer is smaller than the inductance of the second transformer. When using the above-described transformer in the DC-DC converter, the operation of the first transformer can be assigned to the flyback operation and the operation of the second transformer can be assigned to the forward operation. In the second transformer wherein the forward operation is carried out, energy simply passes the transformer but does not have to be accumulated therein. This is because the inductance does not have to be made smaller to prevent magnetic saturation of the core. In the first transformer wherein the fly back operation is carried out, energy needs to be accumulated. This is because the inductance needs to be made smaller to prevent magnetic saturation in the core. Thus, the gaps in the second transformer can be made narrower than those in the first core and the gaps in the second transformer can be dispensed with. As a result, the number of gaps in the overall transformer can be reduced, or the total value of the gap spacing can be reduced.

The transformer according to one aspect, wherein the third magnetic lead either has a gap which is narrower than that in the second magnetic lead or is gap-free.

As the first core and the second core are formed integrally to share the second magnetic lead, the second magnetic lead is positioned substantially at the center of the transformer. Gaps are provided in the second magnetic lead. As a result, if the third magnetic lead is gap-free, a pair of third magnetic leads positioned outside the core contact each other when the core is assembled. This gives structural stability to the assembled core. If the third magnetic lead has gaps which are narrower than those in the second magnetic lead, the third magnetic lead is positioned more outward of the core than the second magnetic lead. This gives structural stability to the assembled core. An effect can thus be achieved whereby changes in the gaps due to oscillation no longer occur.

The transformer according to one aspect, wherein a value of a cross sectional area of the second magnetic lead is equal to or higher than a total value of a cross sectional area of the third magnetic lead and a cross sectional area of the fourth magnetic lead.

The second magnetic lead is shared by the first core and the second core. Thus, the second magnetic lead is circulated by the magnetic flux loop of the first core and the magnetic flux loop of the second core. The third magnetic lead is circulated by the magnetic flux loop of the first core and the fourth magnetic lead is circulated by the magnetic flux loop of the second core. The sectional area of the second magnetic lead is set to a value which is equal to or higher than the total value of the sectional area of the third magnetic lead and the sectional area of the fourth magnetic lead. Thus, a magnetic path for the magnetic flux loop of the first core and a magnetic flux path for the second core can be created. The magnetic flux density of the second magnetic lead can be prevented from becoming higher than the magnetic flux density of the third magnetic lead and the fourth magnetic lead, which makes it possible to prevent an increase in core loss.

According to the present invention, it is possible to provide a transformer capable of reducing core loss and preventing the wiring layout from becoming complicated.

The first transformer primary winding W1 and the second transformer primary winding W3 represent one example of a first winding. The coil 45 represents one example of a third winding. The coil 46 represents one example of a second winding. The coil 47 represents one example of a fourth winding. The transformer T1 represents one example of a first transformer. The transformer T2 represents one example of a second transformer.

What is claimed is:

1. A transformer including an integral output coil, the transformer comprising:

a pair of bottom plates arranged substantially parallel to each other;

a first magnetic lead and a second magnetic lead arranged at a center part of the bottom plates with a predetermined space therebetween;

a third magnetic lead provided outside the first magnetic lead;

a first core formed by the first magnetic lead through the third magnetic lead;

a fourth magnetic lead provided outside the second magnetic lead;

a second core formed by the second magnetic lead and the fourth magnetic lead;

a first winding wound around the first magnetic lead but not the second magnetic lead;

a second winding passing through between the first magnetic lead and the second magnetic lead and forming a first transformer together with the first winding;

a third winding passing through between the first magnetic lead and the third magnetic lead and forming a second transformer together with the first winding; and a fourth winding having one end thereof connected to one end of the second winding and one end of the third winding, the fourth winding passing through between the second magnetic lead and the fourth magnetic lead, wherein the first core with the first winding through the third winding serves as the transformer, and the second core with the fourth winding serves as the integral output coil, and wherein in the first core, magnetic flux generated by the first winding flows through two paths, one of which is a path through the first magnetic lead and the second magnetic lead and the other of which is a path through the first magnetic lead and the third magnetic lead.

2. The transformer according to claim 1, comprising:

a conductor plate with one end thereof bifurcating to form the second winding and the third winding, and other end thereof forming the fourth winding.

3. The transformer according to claim 1, wherein end portions of the second winding through the fourth winding are all arranged in a same side of the transformer.

4. The transformer according to claim 1, wherein either one of the second magnetic lead and the third magnetic lead has a gap; and the other one of the second magnetic lead and the third magnetic lead either has a gap which is narrower than said gap, or is gap-free.

5. The transformer according to claim 1, wherein the third magnetic lead either has a gap which is narrower than that in the second magnetic lead or is gap-free.

6. The transformer according to claim 1, wherein a value of a cross sectional area of the second magnetic lead is equal to or higher than a total value of a cross sectional area of the third magnetic lead and a cross sectional area of the fourth magnetic lead.

7. A DC-DC converter including the transformer according to claim 1, the DC-DC converter comprising:

a first switching element serially connected to the first winding, the first switching element being set in conductive/non-conductive state in a predetermined period;

a first rectifier element in which a first polarity terminal is connected to the other end of the second winding that generates an electromotive force of first polarity when the first switching element conducts, the first rectifier element being biased in a reverse bias condition;

a second rectifier element in which a first polarity terminal is connected to the other end of the third winding that generates an electromotive force of second polarity when the first switching element conducts, the second rectifier element being biased in a forward bias condition;

a connection point which connects a second polarity terminal of the first rectifier element and a second polarity terminal of the second rectifier element;

a common current path in common with a current path which includes the second winding and the first rectifier element and a current path which includes the third winding and the second rectifier element, the common current path connecting the other end of the fourth winding and the connection point; and an output terminal provided on the common current path.

* * * * *